US010059567B2

(12) United States Patent
Martins et al.

(10) Patent No.: US 10,059,567 B2
(45) Date of Patent: Aug. 28, 2018

(54) TRAVELING CABLE SWAY PREVENTION

(71) Applicant: OTIS ELEVATOR COMPANY, Farmington, CT (US)

(72) Inventors: Sebastien Martins, Beaulieu sur Loire (FR); Frederic Bourassin, Lorris (FR); Jean-Baptiste Dubreuil, Neuvy en Sullias (FR); Mathieu Raholijaona, Amilly (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/654,978

(22) Filed: Jul. 20, 2017

(65) Prior Publication Data

US 2018/0029830 A1 Feb. 1, 2018

(30) Foreign Application Priority Data

Jul. 27, 2016 (EP) ..... 16290144

(51) Int. Cl.
*B66B 11/00* (2006.01)
*B66B 11/06* (2006.01)
(Continued)

(52) U.S. Cl.
CPC ..... *B66B 11/0075* (2013.01); *B66B 7/08* (2013.01); *B66B 11/0025* (2013.01);
(Continued)

(58) Field of Classification Search
CPC combination set(s) only.
See application file for complete search history.

(56) References Cited

U.S. PATENT DOCUMENTS 2,017,372 A * 10/1935 Morrison ..... B66B 7/06 187/413
3,882,968 A * 5/1975 Suozzo ..... B66B 7/068 187/264
(Continued)

FOREIGN PATENT DOCUMENTS

CN 101792082 A 8/2010
CN 204096804 U 1/2015
(Continued)

OTHER PUBLICATIONS

European Search Report and Written Opinion; International Application No. 16290144.1; International Filing Date: Jul. 27, 2016; dated Feb. 15, 2017; 9 pages.
(Continued)

*Primary Examiner* — Michael A Riegelman
(74) *Attorney, Agent, or Firm* — Cantor Colburn LLP

(57) ABSTRACT

An elevator system includes an elevator car movable along a hoistway, a traveling cable operably connected to the elevator car and movable along the hoistway with the elevator car, and a traveling cable support positioned in the hoistway and operably connected to the traveling cable to prevent sway of the traveling cable. A traveling cable and traveling cable support arrangement for an elevator system includes a traveling cable positioned in a hoistway and movable in the hoistway during elevator system operation, and a traveling cable support positioned in the hoistway and operably connected to the traveling cable to prevent sway of the traveling cable, the traveling cable support operably connected to the traveling cable via a plurality of guide frames.

15 Claims, 8 Drawing Sheets

(51) Int. Cl.
*B66B 7/08* (2006.01)
*B66B 5/24* (2006.01)
*B66B 7/02* (2006.01)

(52) U.S. Cl.
CPC ..... *B66B 11/06* (2013.01); *B66B 5/24* (2013.01); *B66B 7/026* (2013.01)

(56) References Cited

U.S. PATENT DOCUMENTS

| | | | | |
|---|---|---|---|---|
| 3,885,773 | A * | 5/1975 | Dunkelberger | B66F 9/205 187/413 |
| 4,058,186 | A | 11/1977 | Mullis | |
| 9,067,761 | B2 | 6/2015 | Ropponen et al. | |
| 9,758,344 | B2 * | 9/2017 | Fauconnet | B66B 7/06 |
| 2003/0196857 | A1 * | 10/2003 | Tiner | B66B 7/064 187/413 |
| 2006/0163010 | A1 * | 7/2006 | Ogava | B66B 7/068 187/401 |
| 2010/0243382 | A1 * | 9/2010 | Sterner | B65H 75/362 187/413 |
| 2013/0015022 | A1 | 1/2013 | Sonnenmoser et al. | |
| 2014/0224590 | A1 * | 8/2014 | Puranen | B66B 5/022 187/247 |
| 2014/0353091 | A1 | 12/2014 | Fauconnet et al. | |
| 2016/0083223 | A1 * | 3/2016 | Altenburger | B66B 7/064 187/251 |
| 2016/0159612 | A1 * | 6/2016 | Watanabe | B66B 7/068 187/413 |
| 2016/0207738 | A1 * | 7/2016 | Altenburger | B66B 7/064 |

FOREIGN PATENT DOCUMENTS

| | | | |
|---|---|---|---|
| CN | 105366461 | A | 3/2016 |
| EP | 2460754 | A1 | 6/2012 |
| JP | H01299182 | A | 12/1989 |
| JP | H0313478 | A | 1/1991 |
| JP | 56127574 | A | 10/1991 |
| JP | H05186164 | A | 7/1993 |
| JP | 867456 | A1 | 3/1996 |
| JP | 2005162372 | A | 6/2005 |
| JP | 2010047364 | A | 3/2010 |
| JP | 2011073836 | A | 4/2011 |
| WO | 2009116985 | A1 | 9/2009 |

OTHER PUBLICATIONS

Laney; "Elevator Traveling Cable—Design Evolution"; Internet; URL: http://www.prysmiangroup.com/en/business_markets/markets/elevator/downloads/white-papers/CABLEDES1.pdf; 5 pgs.

* cited by examiner

TRAVELING CABLE SWAY PREVENTION

CROSS-REFERENCE TO RELATED APPLICATIONS

This application claims the benefit of European Patent Application No. 16290144.1 filed on Jul. 27, 2016, which is incorporated herein by reference in its entirety.

BACKGROUND

The subject matter disclosed herein relates to elevator systems. More particularly, the present disclosure relates to prevention of sway of a traveling cable for an elevator system.

Elevator systems typically include one or more elevator cars movable along a hoistway. To provide electrical power for lighting and sound, communications, and other functions such as connections between a car operating panel and the control system of the elevator system, a traveling cable is located in the hoistway with one end connected to, for example, the control system, and another end operably connected to the elevator car.

In some configurations and building conditions, the traveling cable may have a tendency to sway in the hoistway and may mechanically interfere with brackets and/or other components in the hoistway. These conditions include high rise buildings where the traveling cable has a great length, and sway is induced by seismic conditions. In some elevator systems, solutions such as a screen in the hoistway are utilized to protect the hoistway components from interference with the traveling cable. Such solutions, however, do not prevent the traveling cable from swaying, they only mitigate the effects of traveling cable sway. Further, a screen, especially in a high rise elevator system, is not cost effective.

SUMMARY

In one embodiment, an elevator system includes an elevator car movable along a hoistway, a traveling cable operably connected to the elevator car and movable along the hoistway with the elevator car, and a traveling cable support positioned in the hoistway and operably connected to the traveling cable to prevent sway of the traveling cable.

Additionally or alternatively, in this or other embodiments the traveling cable support is operably connected to the traveling cable via a plurality of guide frames.

Additionally or alternatively, in this or other embodiments the plurality of guide frames are movable along the traveling cable and/or along the traveling cable support.

Additionally or alternatively, in this or other embodiments the plurality of guide frames is three guide frames.

Additionally or alternatively, in this or other embodiments one or more stops are positioned along the traveling cable support to limit movement of the plurality of guide frames along the traveling cable support.

Additionally or alternatively, in this or other embodiments the one or more stops are positioned between adjacent guide frames of the plurality of guide frames.

Additionally or alternatively, in this or other embodiments the one or more stops are fixed to the traveling cable support.

Additionally or alternatively, in this or other embodiments the plurality of guide frames includes a support opening engaged with the traveling cable support, and a cable opening engaged with the traveling cable.

Additionally or alternatively, in this or other embodiments the support opening is located at a first end of the guide frame, and the cable opening is located at a second end of the guide frame opposite the first end.

Additionally or alternatively, in this or other embodiments the guide frame includes a coating to reduce friction between the guide frame and the traveling cable support and/or the traveling cable.

In another embodiment, a traveling cable and traveling cable support arrangement for an elevator system includes a traveling cable positioned in a hoistway and movable in the hoistway during elevator system operation, and a traveling cable support positioned in the hoistway and operably connected to the traveling cable to prevent sway of the traveling cable, the traveling cable support operably connected to the traveling cable via a plurality of guide frames.

Additionally or alternatively, in this or other embodiments the plurality of guide frames are movable along the traveling cable and/or along the traveling cable support.

Additionally or alternatively, in this or other embodiments the plurality of guide frames is three guide frames.

Additionally or alternatively, in this or other embodiments one or more stops are positioned along the traveling cable support to limit movement of the plurality of guide frames along the traveling cable support.

Additionally or alternatively, in this or other embodiments the one or more stops are positioned between adjacent guide frames of the plurality of guide frames.

Additionally or alternatively, in this or other embodiments the one or more stops are fixed to the traveling cable support.

Additionally or alternatively, in this or other embodiments the guide frame includes a support opening engaged with the traveling cable support, and a cable opening engaged with the traveling cable.

Additionally or alternatively, in this or other embodiments the support opening is located at a first end of the guide frame, and the cable opening is located at a second end of the guide frame opposite the first end.

Additionally or alternatively, in this or other embodiments the guide frame includes a coating to reduce friction between the guide frame and the traveling cable support and/or the traveling cable.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
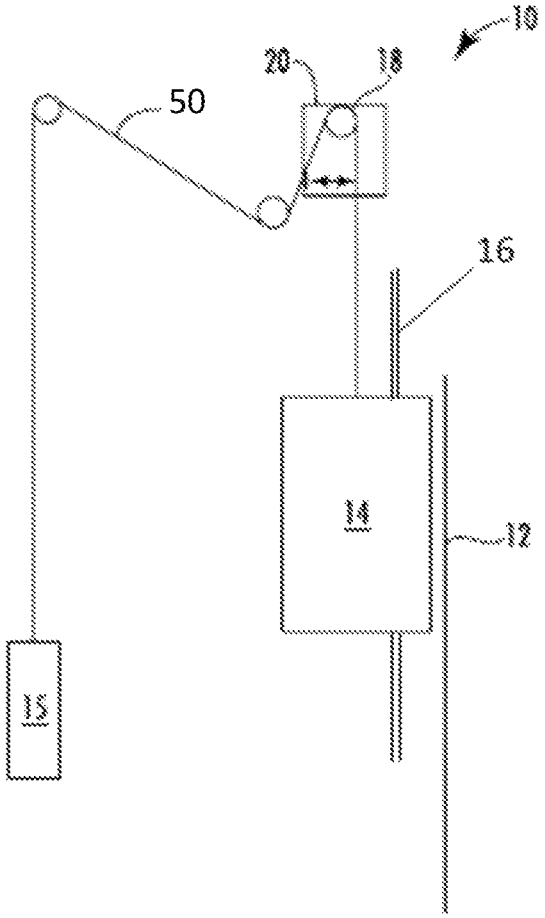
FIG. 1 is a schematic view of an embodiment of an elevator system.

Referring now to FIG. 1, an exemplary embodiment of an elevator system 10 is illustrated. The elevator system 10 includes an elevator car 14 configured to move vertically upwardly and downwardly within a hoistway 12 along a plurality of car guide rails 16. Guide assemblies (not shown) mounted to the top and bottom of the elevator car 14 are configured to engage the car guide rails to maintain proper alignment of the elevator car 14 as it moves within the hoistway 12.

The elevator system 10 also includes a counterweight 15 configured to move vertically upwardly and downwardly within the hoistway 12. The counterweight 15 moves in a direction generally opposite the movement of the elevator car 14 as is known in conventional elevator systems. Movement of the counterweight 15 is guided by counterweight guide rails (not shown) mounted within the hoistway 12. In the illustrated, non-limiting embodiment, at least one load bearing member 50, for example, a belt or a rope is coupled to both the elevator car 14 and the counterweight 15 and cooperates with a drive sheave 18 mounted to a drive machine 20. Thus, the elevator car 14 and the counterweight 15 are moved upwardly and downwardly along the hoistway 12.

Figure 2:
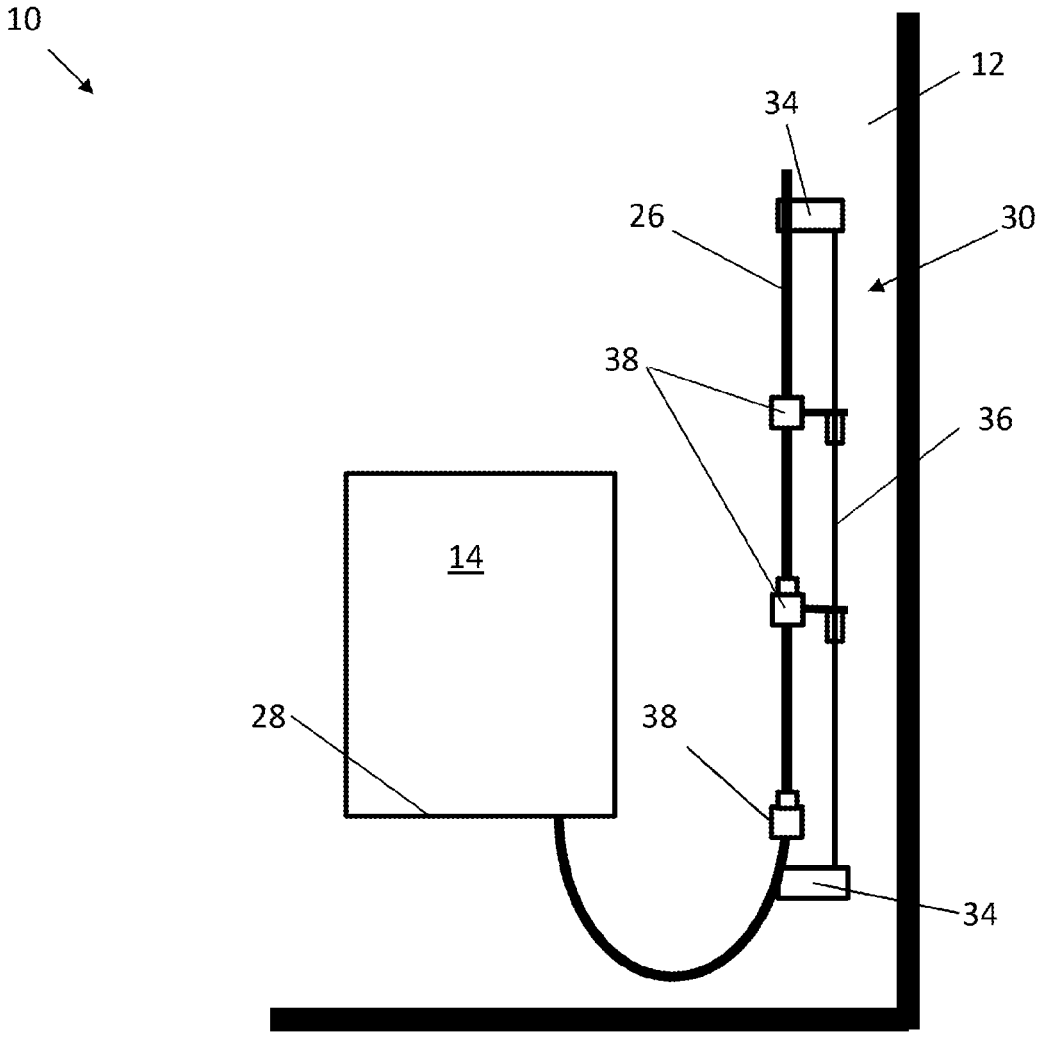
FIG. 2 is a another schematic view of an elevator system including a traveling cable.

Referring to FIG. 2, the elevator system 10 further includes a traveling cable 26 positioned in the hoistway 12 connecting the elevator car 14 to an elevator control system (not shown) via, for example, a car operating panel (not shown) in the elevator car 14. Further, the traveling cable 26 may be utilized to provide electrical power and/or communications to the elevator car 14. In some embodiments, the traveling cable 26 is attached to and/or enters the elevator car 14 at a car floor 28 of the elevator car 14.

Figure 3:
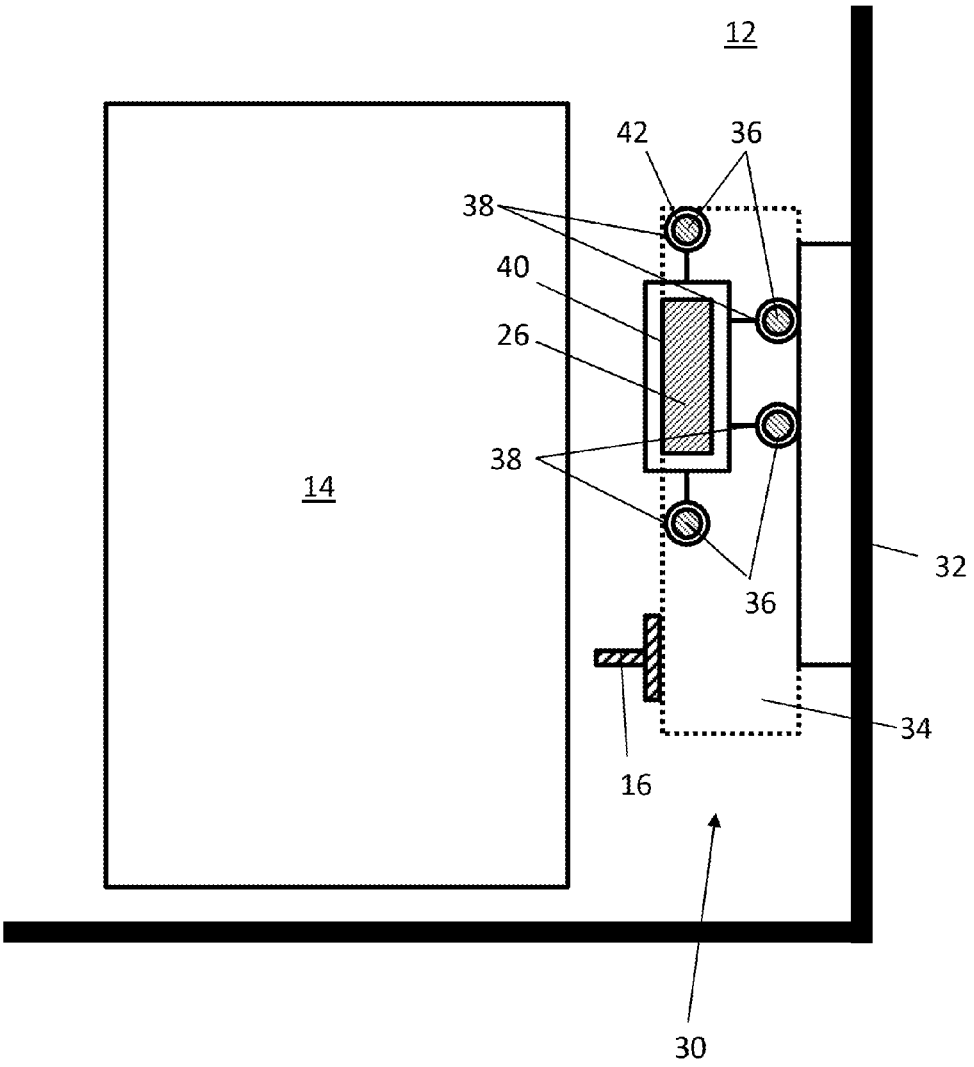
FIG. 3 is a top view of an embodiment of a traveling cable support system for an elevator system.

Referring now to the top view of FIG. 3, to prevent sway of the traveling cable 26 in the hoistway during operation of the elevator system 10, a traveling cable support system 30 is positioned in the hoistway 12, for example, fixed to a hoistway wall 32. The traveling cable support system 30 includes one or more support brackets 34 to which one or more supports 36 are fixed, extending along a length of the hoistway 12. Four supports 36 are shown in FIG. 3, but it is to be appreciated that other quantities of supports 36 may be utilized. In some embodiments, the supports 36 are ropes or bars extending along the hoistway 12. Each support 36 is connected to the traveling cable 26 via a guide frame 38, with the guide frame 38 having a cable opening 40 to engage with the traveling cable 26, and a support opening 42 to engage with the support 36. The support opening 42 and the cable opening 40 are sized and configured to allow the guide frame 38 to move along the traveling cable 26 and along the support 36 as the elevator car 14 moves along the hoistway 12. In some embodiments, the support opening 42 is circular, to engage with a circular support 36. It is to be appreciated, however, that the circular-shaped support opening 42 shown in FIG. 3 is merely exemplary, and support openings 42 of other cross-sectional shapes such as triangular, oval, rectangular or T-shaped may be utilized to engage similarly shaped supports 36. In some embodiments, each guide frame 38 connects the traveling cable 26 to a different support 36. In some embodiments, the support opening 42 and/or the cable opening 40 include a coating to reduce friction between the guide frame 38 and the traveling cable 26 and/or between the guide frame 38 and the support 36 for smooth operation of the traveling cable support system 30.

Figure 4:
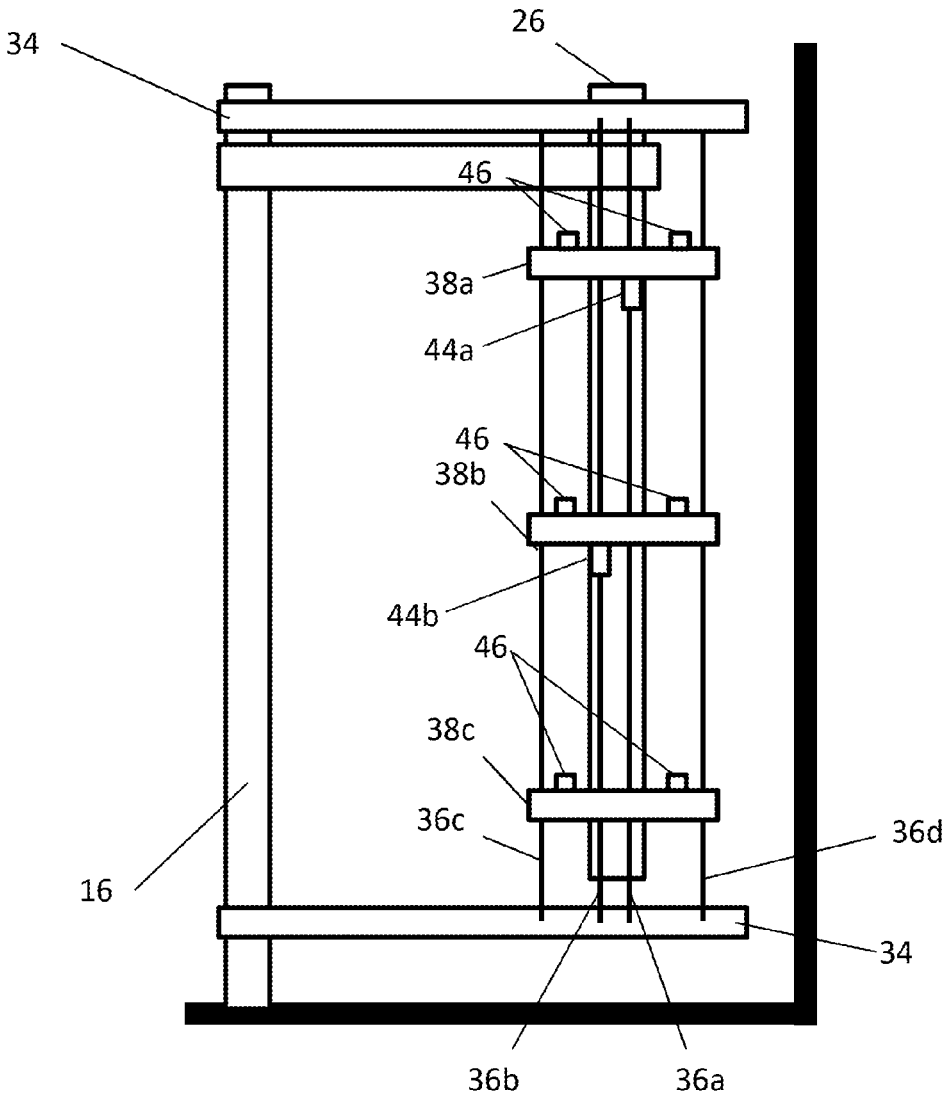
FIG. 4 is a side view of an embodiment of a traveling cable support system for an elevator system.

Referring now to the side view of FIG. 4, an embodiment is shown having three guide frames 38*a*, 38*b*, 38*c* and four supports 36*a*, 36*b*, 36*c*, 36*d*. First guide frame 38*a* is engaged to support 36*a*, while second guide frame 38*b* is engaged to support 36*b* and third guide frame 38*c* is engaged to support 36*c*. Stops 44*a*, 44*b* are utilized to limit downward travel of guide frames 38*a* and 38*b*, respectively, while downward travel of guide frame 38*c* is limited by a lowest portion of the travelling cable 26, or travelling cable loop 52 (shown best in FIG. 5). For example, stop 44*a* is positioned along support 36*a* to prevent downward movement of first guide frame 38*a* beyond stop 44*a*. Further, the guide frames 38*a*, 38*b*, 38*c* include one or more buffers 46 positioned to prevent collision with adjacent guide frames 38*a*, 38*b* and 38*b*, 38*c*.

Figure 5:
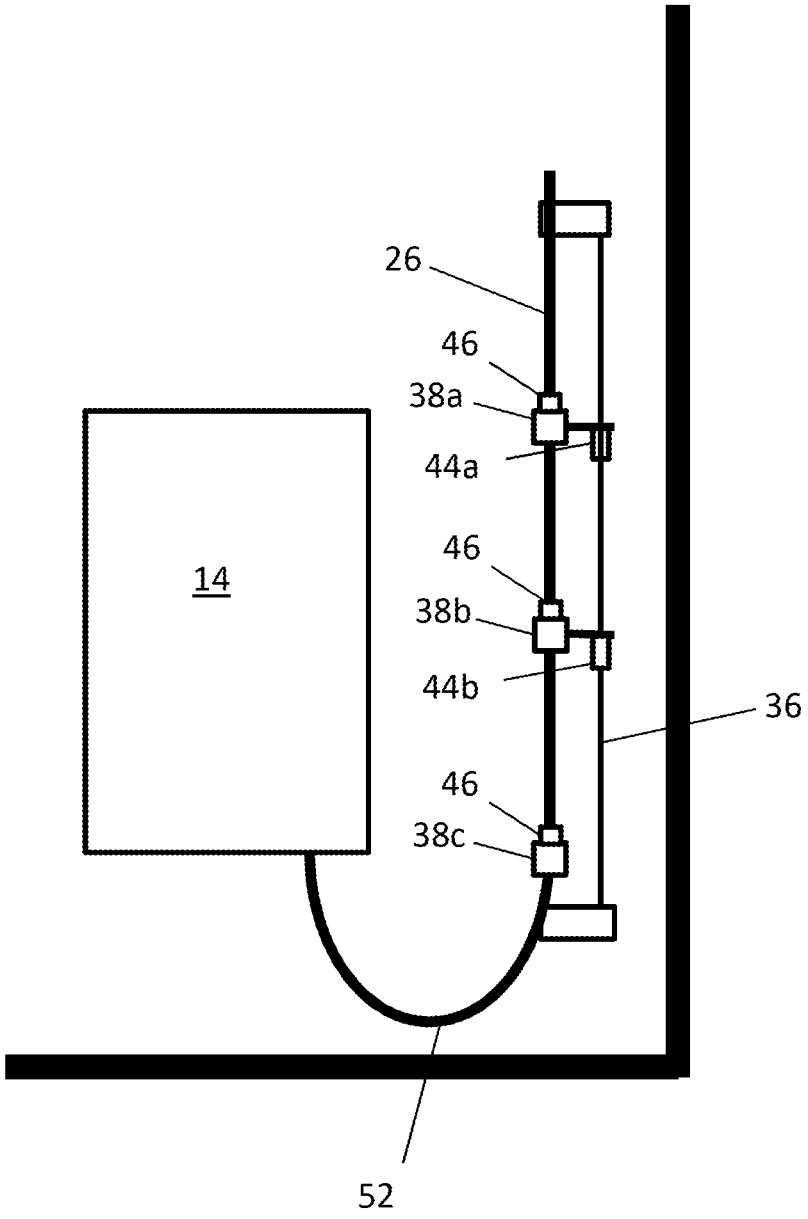
FIG. 5 is a schematic view of an elevator system with a traveling cable support system, with an elevator car disposed at a first position in a hoistway.
Figure 6:
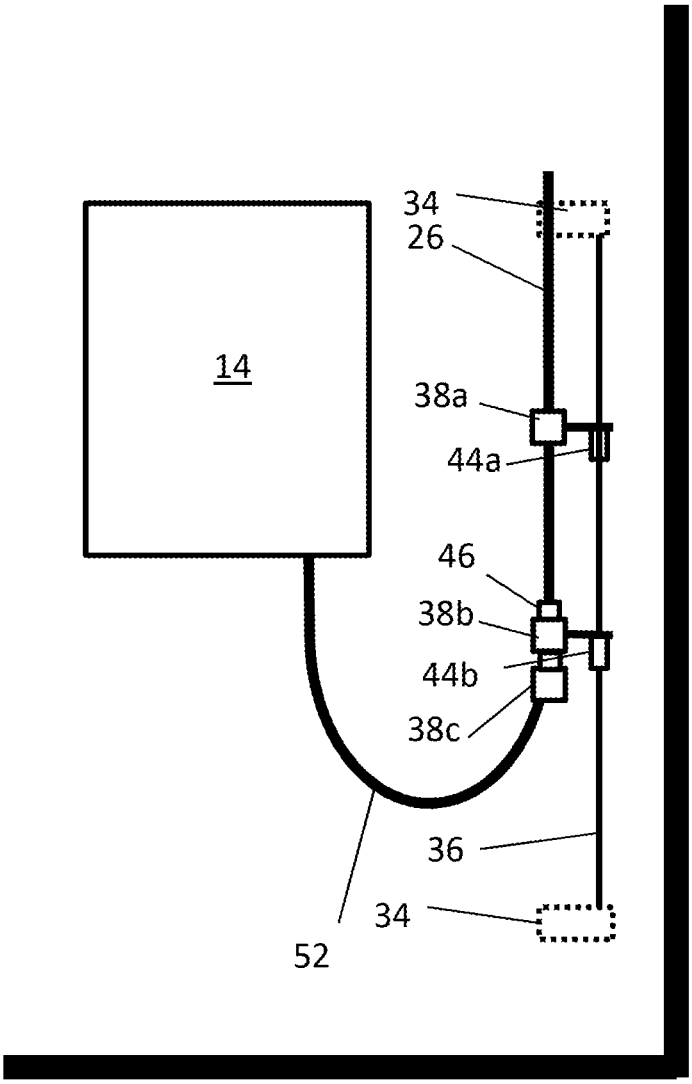
FIG. 6 is a schematic view of an elevator system with a traveling cable support system, with the elevator car positioned at a second position in the hoistway.
Figure 7:
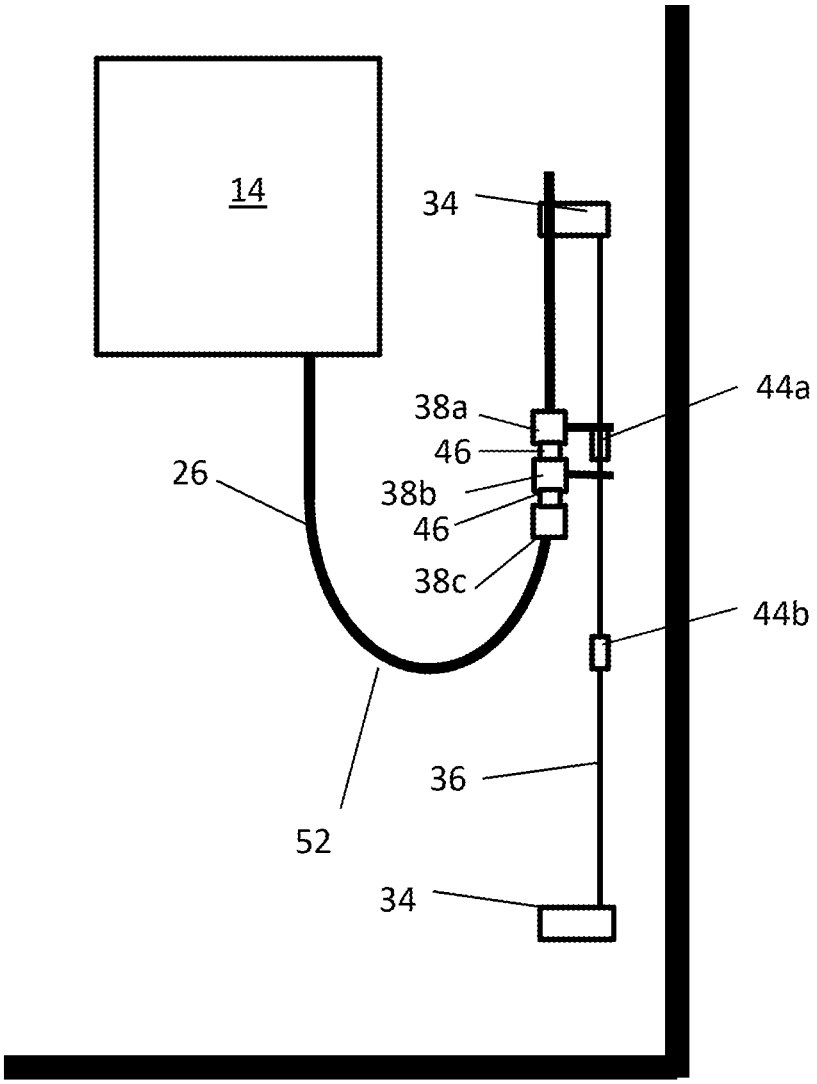
FIG. 7 is a schematic view of an elevator system with a traveling cable support system, with the elevator car positioned at a third position in the hoistway.
Figure 8:
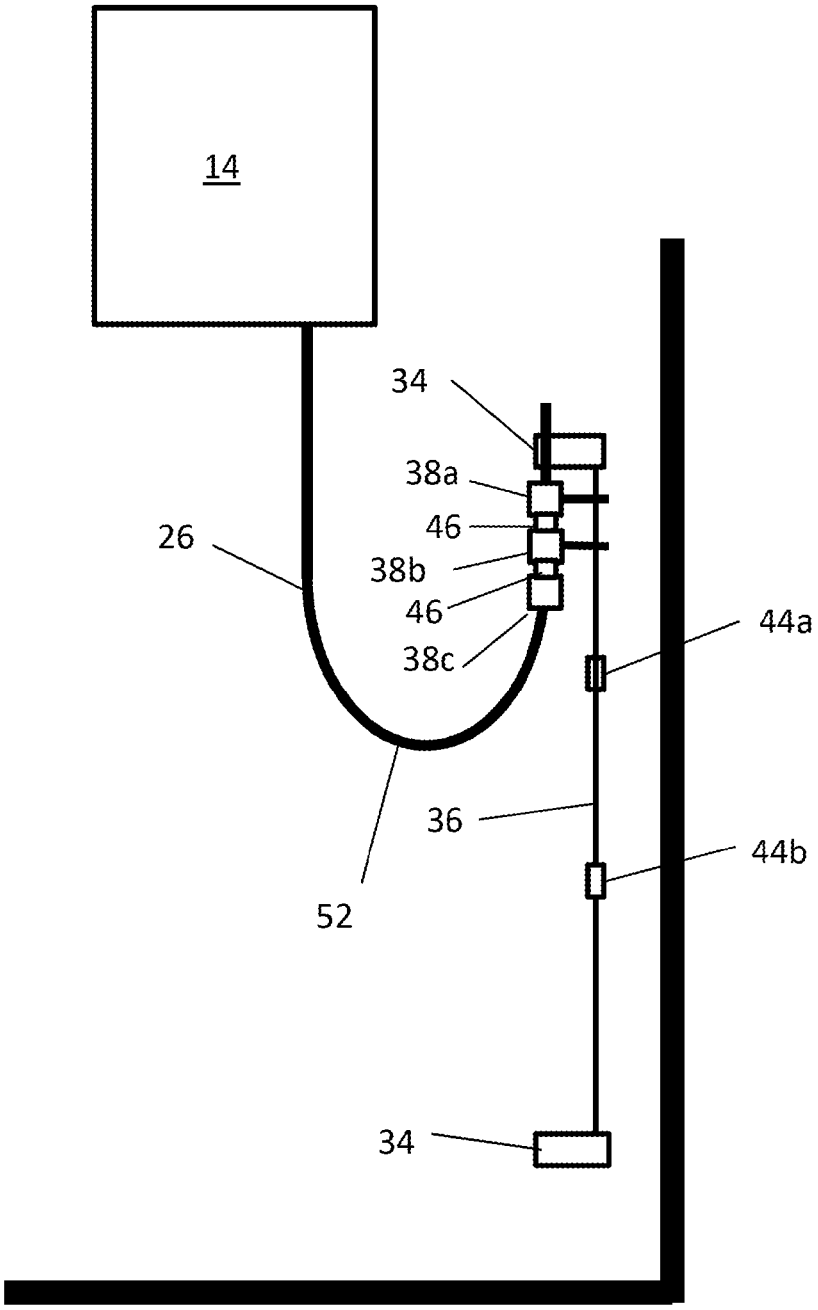
FIG. 8 is a schematic view of an elevator system with a traveling cable support system, with the elevator car positioned at a fourth position in the hoistway.

Operation of the traveling cable support system 30 will now be described with reference to FIGS. 5-8. In FIG. 5, the elevator car 14 is located at the bottom of the hoistway 12 and the guide frames 38*a* and 38*b* are located at their associated stops 44*a* and 44*b*. In FIG. 6, the elevator car 14 has moved upward in the hoistway 12 such that the traveling cable 26 urges the first guide frame 38*a* upwardly into contact with the second guide frame 38*b* via the buffer 46 between the first guide frame 38*a* and the second guide frame 38*b*. As the elevator car 14 continues to travel upward, the traveling cable 26 urges the first guide frame 38*a* and the second guide frame 38*b* upward together into contact with the third guide frame 38*c* via the buffer 46 between the second guide frame 38*b* and the third guide frame 38*c*, as shown in FIG. 7. As shown in FIG. 8, when the elevator car 14 is at the top of the hoistway 12, the guide frames 38*a*-38*c* are all located at the support bracket 34.

Similarly, as the elevator car 14 begins to travel downwardly from the top of the hoistway 12, the guide frames 38*a*-38*c* are all located at the support bracket 34. As the elevator car 14 travels downwardly, guide frame 38*a* stops downward travel at stop 44*a*, and guide frame 38*b* stops travel at stop 44*b*, while guide frame 38*c* continues to travel downwardly with the elevator car 14.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

What is claimed is:

1. An elevator system, comprising:

an elevator car movable along a hoistway;

a traveling cable operably connected to the elevator car and movable along the hoistway with the elevator car;

a traveling cable support disposed in the hoistway and operably connected to the traveling cable to prevent sway of the traveling cable; and a plurality of guide frames extending from the traveling cable to the travelling cable supports and slidably along the traveling cable support, a guide frame of the plurality of guide frames including:

a support opening enclosing the traveling cable support; and a cable opening enclosing the traveling cable.

2. The elevator system of claim 1, wherein the plurality of guide frames are movable along the traveling cable and/or along the traveling cable support.

3. The elevator system of claim 1, wherein the plurality of guide frames is three guide frames.

4. The elevator system of claim 1, further comprising one or more stops disposed along the traveling cable support to limit movement of the plurality of guide frames along the traveling cable support.

5. The elevator system of claim 4, wherein the one or more stops are positioned between adjacent guide frames of the plurality of guide frames.

6. The elevator system of claim 4, wherein the one or more stops are fixed to the traveling cable support.

7. The elevator system of claim 1, wherein:

the support opening is disposed at a first end of the guide frame; and the cable opening is disposed at a second end of the guide frame opposite the first end.

8. The elevator system of claim 1, wherein the guide frame includes a coating to reduce friction between the guide frame and the traveling cable support and/or the traveling cable.

9. A traveling cable and traveling cable support arrangement for an elevator system, comprising:

a traveling cable disposed in a hoistway and movable in the hoistway during elevator system operation; and a traveling cable support disposed in the hoistway and operably connected to the traveling cable to prevent sway of the traveling cable, the traveling cable support operably connected to the traveling cable via a plurality of guide frames, the plurality of guide frames movable along the traveling cable and along the traveling cable support a guide frame of the plurality of guide frames including:

a support opening enclosing the traveling cable support; and a cable opening enclosing the traveling cable.

10. The traveling cable and traveling cable support arrangement of claim 9, wherein the plurality of guide frames is three guide frames.

11. The traveling cable and traveling cable support arrangement of claim 9, further comprising one or more stops disposed along the traveling cable support to limit movement of the plurality of guide frames along the traveling cable support.

12. The traveling cable and traveling cable support arrangement of claim 11, wherein the one or more stops are positioned between adjacent guide frames of the plurality of guide frames.

13. The traveling cable and traveling cable support arrangement of claim 11, wherein the one or more stops are fixed to the traveling cable support.

14. The traveling cable and traveling cable support arrangement of claim 9, wherein:

the support opening is disposed at a first end of the guide frame; and the cable opening is disposed at a second end of the guide frame opposite the first end.

15. The traveling cable and traveling cable support arrangement of claim 9, wherein the guide frame includes a coating to reduce friction between the guide frame and the traveling cable support and/or the traveling cable.

* * * * *